United States Patent [19]

O'Neal

[11] 3,934,794

[45] Jan. 27, 1976

[54] VOTING MACHINE WITH BAND INTERLOCK

[75] Inventor: Cothburn M. O'Neal, Dallas, Tex.

[73] Assignee: The Riverside Press, Inc., Dallas, Tex.

[22] Filed: June 3, 1974

[21] Appl. No.: 475,418

[52] U.S. Cl. ..... 235/54 A; 235/54 D; 235/55 A

[51] Int. Cl.[2] ..... G07C 13/00

[58] Field of Search ..... 235/54 D, 54 A, 55 A, 51

[56] References Cited

UNITED STATES PATENTS

| | | | |
|---|---|---|---|
| 693,039 | 2/1902 | Luellen | 235/55 A |
| 856,997 | 6/1907 | Cutter et al. | 235/55 A |
| 2,110,297 | 3/1938 | Gustavson | 235/54 A |

*Primary Examiner*—Stephen J. Tomsky

*Attorney, Agent, or Firm*—Hubbard, Thurman, Turner & Tucker

[57] ABSTRACT

A voting machine includes a band interlock system for limiting the number of selections made. A plurality of aligned moveable selector keys are provided with cam surfaces on each key shaft. A rotatable column locking mechanism is mounted adjacent each key having a pair of removeable pins, one pivotal about the other. A slide device connects each key with the adjacent locking mechanism to rotate the mechanism as the key is depressed. A metal interlock band is threaded between each pair of removeable pins of selected column locking mechanisms to interconnect the corresponding voting keys. The interlock band is secured between clamps with a predetermined amount of slack. As each selection is made, the locking mechanism corresponding to the voted selection key pivots to reduce the slack in the interlock band. After a certain number of selections, the slack in the interlock band has been eliminated and the band is taut against the selected locking mechanism so that additional mechanisms cannot be rotated. The blocked locking mechanisms in turn prevent further voting acting through their corresponding slide devices which abut the cam surfaces of the voting keys. A row locking mechanism is also disposed adjacent each selector key for interconnecting the key with other selector keys in the same row or in other rows.

19 Claims, 18 Drawing Figures

VOTING MACHINE WITH BAND INTERLOCK

BACKGROUND AND SUMMARY OF THE INVENTION

This invention relates generally to voting machines and more particularly to an improved voting machine of the general construction described in commonly assigned U.S. Pat. application Ser. No. 309,174, filed by Cothburn M. O'Neal, et al on Nov. 24, 1972, now U.S. Pat. No. 3,866,826.

Many types of mechanical voting machines are shown in the prior art. U.S. Pat. Nos. 3,524,969 and 3,630,434, both granted to the applicant, show and describe a compact, light weight manually-operated machine which may be used in primary and general elections. That system provides for straight ticket, selective and write-in voting and includes a punch card assembly for recording each voter's selections. A vertical interlock system utilizes columns of steel balls to block selector keys after a certain number of choices were made. Mechanical counters are also used to total the votes for each candidate.

U.S. Pat. application Ser. No. 309,174 represents an improvement on the previous system in several respects. The key-ball design for the vertical interlock system was improved to allow selections to be made in any order. A horizontal interlock was added utilizing plungers and key cams to interconnect horizontal keys rows for primary elections. A unique clutch and drive mechanism was added to automatically perform many functions, such as clearing and locking.

The present invention is directed to unique and substantial improvements to the previously described machines. Metal bands are utilized in conjunction with rotatable locking mechanisms to limit the number of voting selections. The bands extend parallel to rows or columns of selector keys between rotatable locking mechanisms adjacent the keys. The bands are clamped at spaced intervals to define selection groups. A specific amount of slack is left in each band portion corresponding to the allowed number of selections in the group. Each time a selector key is pushed the corresponding locking mechanism rotates, reducing the slack in the band. After a predetermined number of selections, the band is taut against all the locking mechanisms in the selection group preventing rotation of additional locking mechanisms. This action locks the other interconnected keys to prevent further selections from being made.

The use of a band interconnect system allows numerous combinations of selector keys to be included in a selection group. The band is threaded between a pair of removeable pins on each rotatable locking mechanism included in the group. If the pins are removed from a locking mechanism, the corresponding selector key is disabled and excluded. A second similar locking mechanism is provided adjacent each selector key so that the key can be interconnected in two separate voting groups.

In accordance with one aspect of the present invention, a mechanical interlock is provided for a voting machine having a plurality of aligned voting keys, each key being moveable between an unvoted position and a voted position. Each key is provided with a cam surface abutting an adjacent slide means which is shifted in response to movement of the key. A pivoting device adjacent each key is provided for rotation in response to movement of the slide means. The pivot devices associated with certain voting keys, are interconnected by an interlocking means which blocks rotation of the pivot devices after a predetermined number of voting keys have been moved to the voted position. The blocked rotation of the remaining pivot means prevents movement to the voted position of additional voting keys within the voting group defined by the interlocking means.

In accordance with another aspect of the present invention, a voting machine includes a plurality of aligned voting keys, each key being moveable from an unvoted position to a voted position. Shiftable means are provided for movement in response to selection of certain voting keys. A band interlock is disposed adjacent the voting keys for blocking movement of the shiftable means after a predetermined number of keys have been selected, thus preventing other keys from being moved to the voted position.

In accordance with yet another aspect of the present invention, a voting machine includes a frame member and a plurality of aligned voting keys moveable from a first to a second position. A slide bar is associated with a cam surface on each voting key for shifting normal to the key in response to key movement. A pivot piece adjacent each key is mounted above the slide bar for rotation in response to slide bar movement. The pivot piece includes a first pivot pin rotatable around a second pivot pin about an axis parallel to the longitudinal axis of the key. An interlocking band extends parallel with the voting keys between each of the first and second pivot pins. The band is secured at both ends and has a predetermined amount of slack which is partially taken up as each pair of pivot pins rotates. After a predetermined number of keys have been moved to the second position, the band is taut, blocking rotation of other pairs of pivot pins in contact with the band. The corresponding pivot pieces block shifting of their related slide bars which in turn prevent movement of further voting keys to the second position.

In accordance with yet another aspect of the present invention, a voting machine is provided having moveable selection keys aligned in vertical columns and horizontal rows on frame members. A vertical column interlock is provided for limiting the number of selected keys in any given column, including a slide in contact with each of the keys for shifting transverse to the keys in response to a selection. A first pivot piece is responsive to movement of the slide for rotation against a first interlocking band which connects the first pivot piece with other similar first pivot pieces. After a first predetermined number of selections has been made, the other first pivot pieces are blocked by the first band interlock from further rotation. A horizontal row interlock is provided including a second pivot piece adjacent each of a selected group of voting keys for responding to movement of the respective slides when a selection is made. A second interlocking band connects the pivot pieces of the second voting group to block rotation of additional second pivot pieces after a second predetermined number of selections has been made.

In summary, the present invention provides for interconnecting numerous combinations of selector keys into voting groups and will allow selection of any number of candidates from within each voting group. The band interlocking system of the present invention is particularly useful in unusual election situations where several votes may be registered in any combination within a voting group. For example, some states permit a candidate to run under more than one party, but he cannot receive more than one vote from each voter. The candidate's name must therefore appear more than once on the ballot to enable straight party voting. At the same time the system must insure that the candidate is not voted for twice on the same ballot by interconnecting the voting keys related to each appearance of the candidate's name.

In some at-large elections a number of votes are allowed within a voting group in various combinations. For example, in one state election for legislators, three votes may be registered for a group of candidates in any combination of three votes for one man, 1½ votes for two candidates, or one vote for each of the three candidates. The voting possibilities require a specially designed complex interconnected system. The band interlocking system of the present invention eliminates the need for a special machine, since the selector keys may be interconnected in any order.

Numerous other voting situations may arise which can easily be handled by slight modifications of the disclosed machine. The present invention provides for a generalized voting machine with an interlocking system which can be interconnected in any order to satisfy many unusual voting requirements. The invention comprises a compact, simple to operate console voting machine for easy handling and storage. As in the previously described system, the present invention has provision for straight party, write-in and random voting procedures. The system of the present invention includes the automatic clutch and drive mechanisms, the computer punch card assembly, and the counter system which has been shown and described in copending U.S. Pat. application Ser. No. 309,174. These aspects of the voting machine are not considered to be part of the invention for purposes of the present application and reference is made to the previously mentioned patent application for a more complete disclosure of those features.

DESCRIPTION OF THE DRAWINGS

A more complete understanding of the invention may be had by referring to the following detailed description when taken in conjunction with the accompanying drawings, wherein.

DETAILED DESCRIPTION OF THE PREFERRED EMBODIMENT

Figure 1:
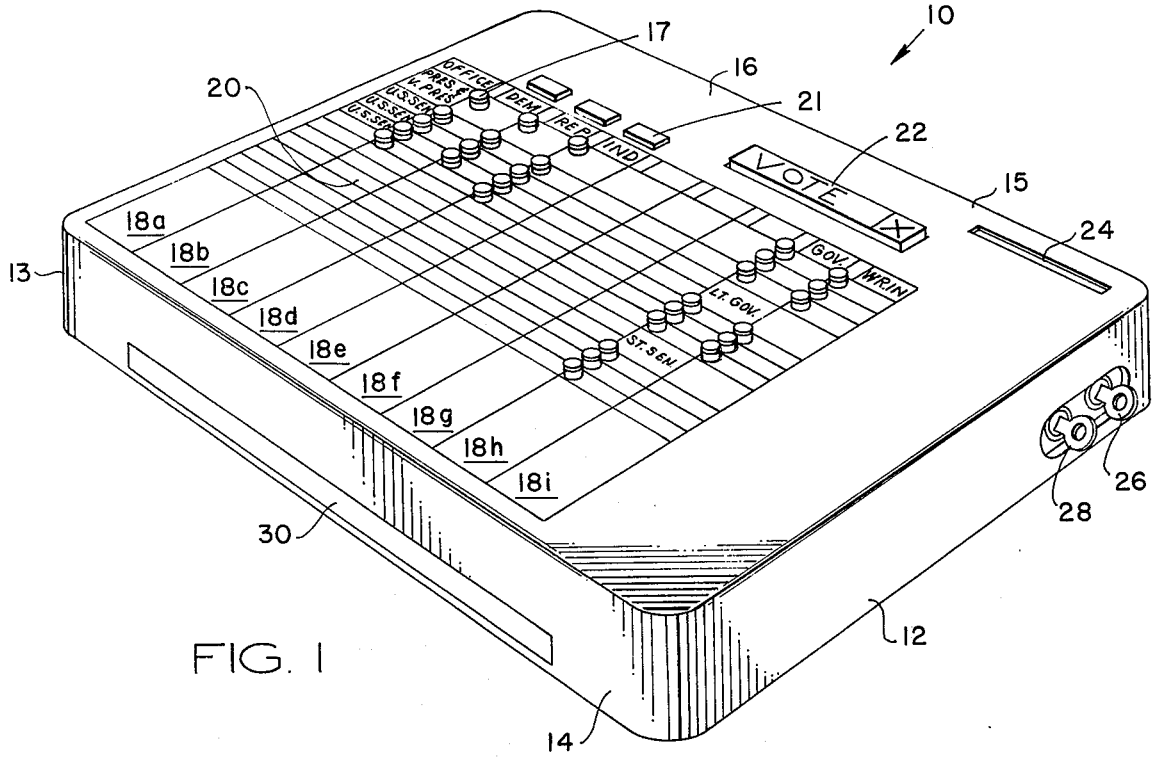
FIG. 1 is a perspective view of the voting machine of the present invention with a representative ballot in position.

Referring to FIG. 1, a voting machine 10 incorporating the present invention is shown. The machine is essentially the same as that shown in U.S. Pat. application Ser. No. 309,174, except for the voting keys and interlocking systems which are the subject of this application. The other features of the voting machine will be described only generally for clarity in better understanding the present invention. Reference is made to U.S. Pat. application Ser. No. 309,174 for greater detail concerning the other features of the voting machine.

The voting machine 10 is normally placed in an appropriate cabinet, not shown, for convenient voter access when in use. The housing of voting machine 10 includes side members 12 and 13 and end members 14 and 15. A top panel 16 provides a selection area with voting buttons 17 and a ballot 20. The ballot is divided into a series of eight selection columns indicated by **18*a*–18*i*. Ballot 20 is not a typical voting ballot, but is presented here only to illustrate the operation of the machine. In left hand columns 18*a*, 18*b*, 18*c* and 18*d*, the ballot format shown is the type normally used in general elections in which several political parties each present a candidate for election to a particular office. Candidate groups are presented in rows, and a voter is allowed to make one selection for each office from columns 18*b*, 18*c*, or 18*d*. Further selections for that office are precluded by the row interlock system of the present invention. At the top of each of columns 18*b*–18*d* is a straight party button 21** which may be depressed if all candidates for a given party are selected.

A typical primary election ballot is illustrated in columns **18*h* wherein candidate groups are listed in a column beneath each office for selection to represent a particular party. A column interlock system allows a voter to select a given number of candidates within each office group in a column and then locks out votes for additional candidates. It is understood that any number of rows and columns may be provided as shown in FIG. 1** with candidate groupings being determined by arrangement of the interlock systems mentioned.

A slot 24 in the upper right area of top panel 16 is provided for data processing cards to be inserted and punched in response to a voter selection. A resetting lock 26 is provided for locking and releasing the voting machine after each vote is recorded. A columns lock 28 can be used to lock out of operation of certain selected columns or a partial column. The keys for locks 26 and 28 are held by an election official during voting operation.

A main vote button 22 is provided near the top center of panel 16 for activating the vote recording mechanisms after the voter's selections are made. A tray 30 accessible through front 15 contains tally counters and a public counter. For a more complete understanding of the counters, reference is made to U.S. Pat. No. 3,821,522 issued on June 28, 1974. Greater detail concerning the card punch mechanism is given in U.S. Pat. application Ser. No. 309,192 filed on Nov. 24, 1972.

Figure 2:
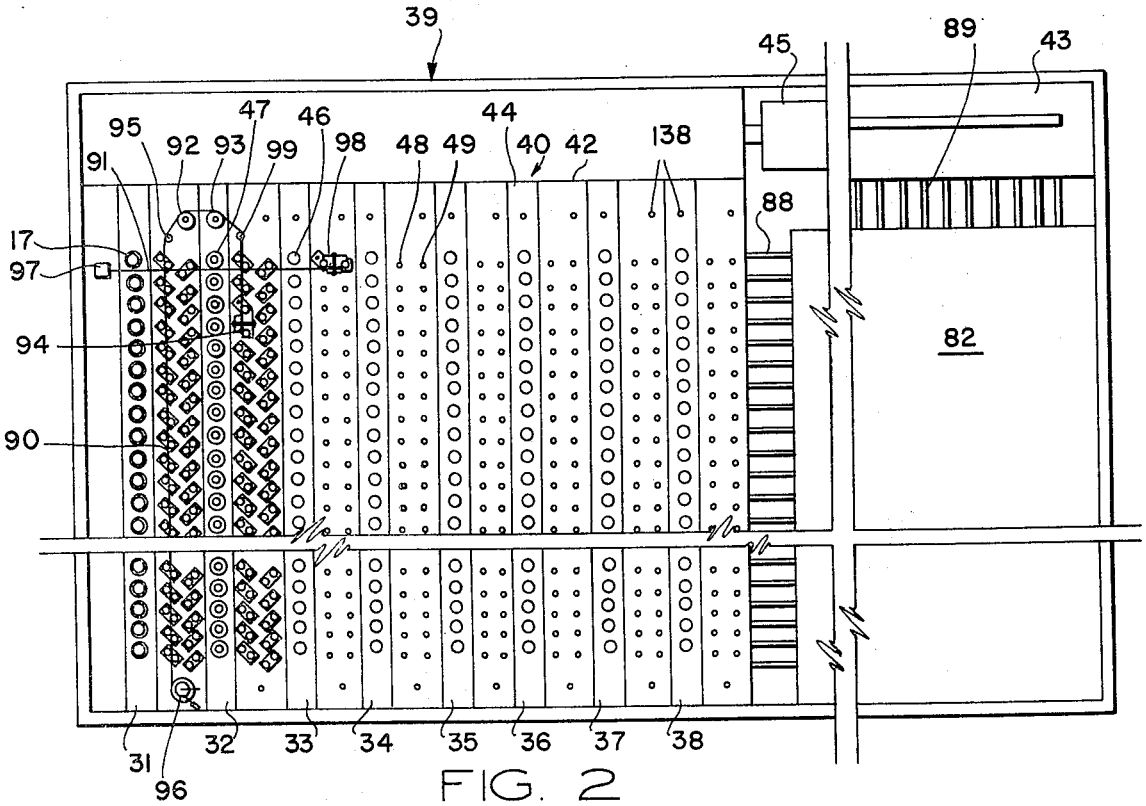
FIG. 2 is a top view of the voting machine with the ballot removed.
Figure 3:
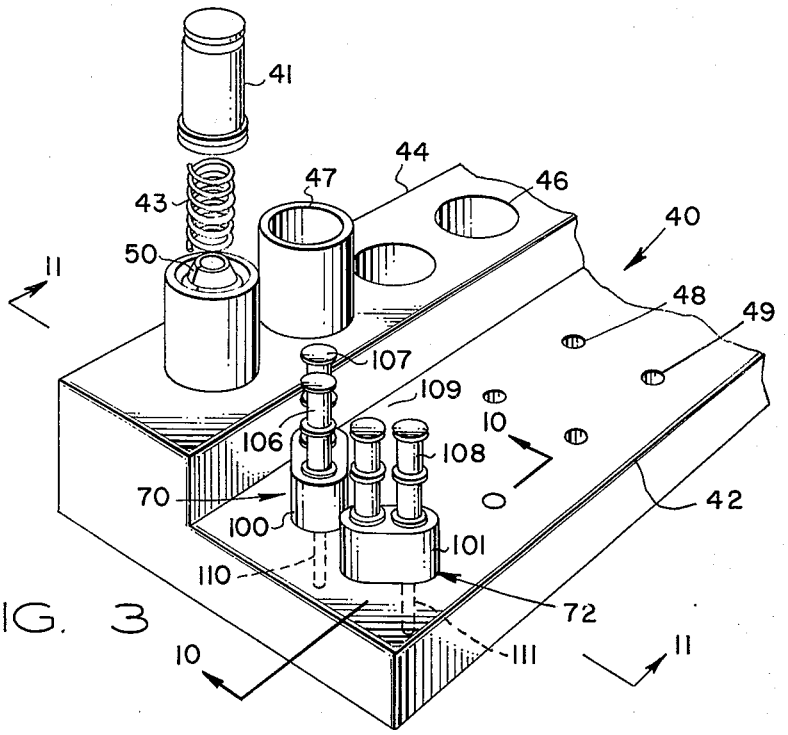
FIG. 3 is a perspective partial view of the machine of FIG. 2.

With reference to FIG. 2, voting machine 10 is shown with top panel 16 and its associated ballot removed. A structural framework 39 includes eight columns 31–38 corresponding to columns 18*a* –18*i* of ballot 20. Each of the columns 31–38 are similar in construction and include an elongate member 40, more clearly illustrated in FIG. 3. Each elongate member is of integrally molded plastic and comprises a broad lower level 42 and an adjacent narrow upper level 44 both running along the full length of member 40. As shown in column 32 of FIG. 2 and in FIG. 3, upper level 44 is provided with annular bores 46 evenly spaced vertically along member 40. Within each bore 46 is a press fit tube 47 which projects upward above upper level 46. A key slide 50 is reciprocably disposed within each of tubes 47, projecting downward into member 40. The outer end of slide 50 is capped by a removeable vote button 41 having a general cylindrical shape to fit over the end of slide 50. A compression coil spring 43 is provided to extend circumferentially within button 41 and engage the end of key slide 50. Spring 43 acts as a buffer to protect slide 50 from extreme external forces. On lower level 42 a pair of spaced holes 48 and 49 is provided adjacent each bore 46. As shown in FIGS. 2 and 3, holes 48 and 49 support pivot pieces 70 and 72, respectively which are used in the interlocking system of the present invention.

FIG. 2 shows column 31 prepared for voting, except for top panel 16 and ballot 20. In column 32, buttons 17 have been removed to show key slides 50 disposed in press tubes 47. Column 33 shows pivot pieces 70 and 72 also removed from lower level 42 leaving holes 48 and 49. It will be understood that the remaining columns are of similar construction and are not fully shown only for purposes of simplicity.

The mechanisms shown at the right side of voting machine 10 are unchanged from that shown and described in previously mentioned U.S. Pat. application Ser. No. 309,174 and will not be described in great detail here. Briefly, rods 88 extend from key slides 50 to a punch bank selector 82 at the right side of voting machine 10. The movement of a key slide 50 downward causes a corresponding rod 48 to be displaced to the right into punch bank selector 82. This motion will block a corresponding punch selector bar 89 so that upon actuation of the voting cycle by main voting button 22, a card inserted in slot 24 of a card punching mechanism 83 will be perforated in a pattern corresponding to the voter's choice. An electric motor 45 is provided adjacent card punching mechanism 43 for carrying out the voting and other powered functions of machine 10.

As shown in FIG. 2, a column interlocking band 90, preferably of metal, is threaded through each column locking pivot piece of column 31. Interlocking band 90 is carried over to column 32 by way of a stationary post 95 and a removeable spool 92 at the top of column 31 and a second removable spool 93 and a post 99 at the top of column 32. Holes 95 are provided across the top part of framework 39 above each column for additional spools as needed. The upper end of interlocking band 90 is secured by a clamp 94, as shown in column 32. The lower end of metal band 90 is connected to a spool and ratchet mechanism 96 for adjusting the tension on the band to a desired degree. Although an interlocking band is shown only in columns 31 and 32, and spools and ratchets are only shown in connection with that metal band, it is understood that similar mechanisms may be provided for the other columns 33-38. A row interlock band 91 is shown in FIG. 2 threaded to interlock the top row of columns 31 and 32. An anchor 97 on the left side is removeably attached to the framework 39 and grips band 91 firmly. A clamp 98 in column 33 similar to clamp 94 grips the other end of band 91 as will be explained in more detail. Having now briefly shown and described the present invention, reference is made to the following figures for a more complete understanding.

Figure 4:
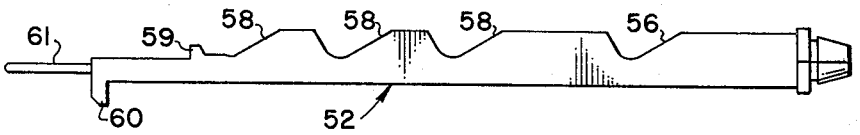
FIGS. 4 and 5 are elevational views of the voting key used in the voting machine of the present invention.
Figure 5:
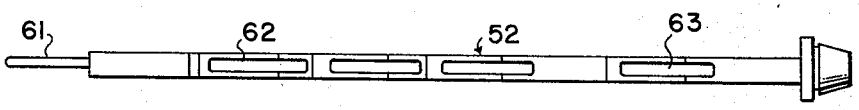

Referring first to FIGS. 4 and 5, key slide 50 is shown in detail. The main body of slide 50 comprises a thin rectangular shank 52 preferably of a light weight molded plastic. A cam shaped ramp 56 is provided along one edge of the upper part of shank 52. Three similar cams 58 are spaced along the same edge of the lower part of shank 52. The surface of each of cams 58 includes grooves 62 for receiving the ends of rods 88. A shoulder 59 extends near the lower end of lower shank 53 for engaging a clear bar of the drive mechanism to return the key slide to a non-voted position. On the opposite side of lower shank 53 is a projection 60 adapted for engagement when a straight party is being voted. Projecting outward from the end of lower shank 53 is a plunger 61 for activating the counters previously mentioned. All parts of the key slide 50, except cam-shaped ramp 56, interact with other parts of the voting machine as described in U.S. Pat. application Ser. No. 309,174 to which reference is made for a detailed description.

Figure 6:
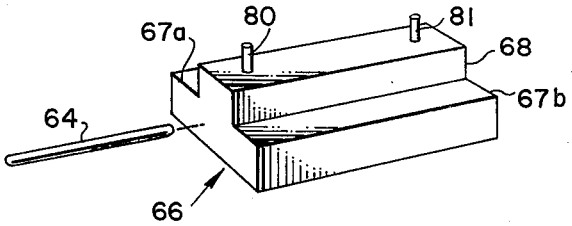
FIG. 6 is a perspective view of the slide bar and the slide pin used in conjunction with the voting key of FIGS. 3 and 4.
Figure 11:
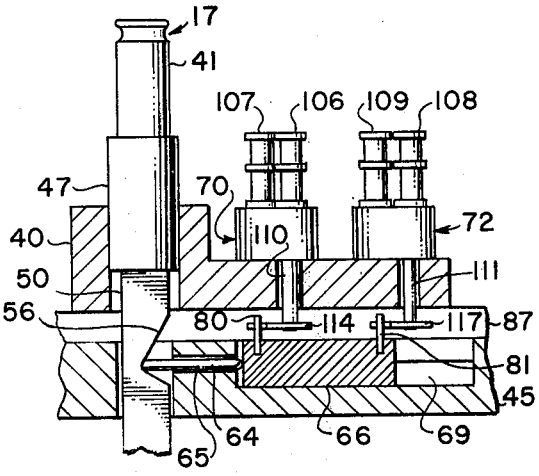
FIG. 11 is a partial sectional view of the voting machine shown in FIG. 3 taken along lines 11—11.

Cam-shaped ramp 56 comprises the portion of key slide 50 interacting with the interlock mechanism of the present invention. A groove 63 similar to groove 62 is provided in cam-shaped ramp 56 to receive a slide pin 64 as shown in FIG. 6. Pin 64 comprises a small solid metal cylinder having rounded ends for following groove 63. Referring to FIG. 11, a bottom plate 45 is provided below elongate member 40. An annular groove 65 in bottom plate 45 contains slide pin 64 for reciprocation transverse to key slide 50. A slide bar 66 is provided adjacent slide pin 64 abutting the end of pin 64 remote from key slide 50 to reciprocate in response to the movement of pin 64. Slide bar 66, shown more clearly in FIG. 6, is preferably a molded plastic piece having the shape of an inverted T with shoulders 67*a* and 67*b* on either side of a center stem 68. Extending upward from the top of slide bar 66 are two small connecting pins 80 and 81 in longitudinal alignment along center stem 68.

Figure 7:
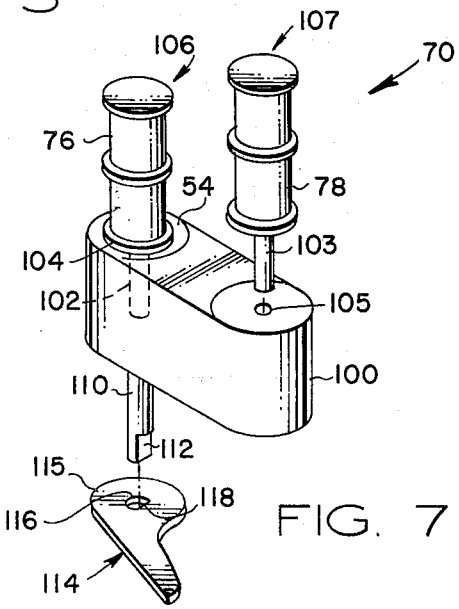
FIG. 7 is an exploded perspective view of the pivot interlocking mechanism associated with the slide device of FIG. 5.

Referring now to FIG. 7, the vertical locking pivot pieces 70 are shown in greater detail. Each pivot piece 70 includes a main body 100 having an elliptical cross section with holes 104 and 105 through the body 100 at the focal points of the ellipse. Removeable pivot pins 106 and 107 are provided having lower and upper cylindrical surfaces 76 and 78 respectively. A small shaft 102 and 103 respectively extends downward from the center of the base of each pivot pin and is sized to fit snugly into each of holes 104 and 105. Two annular surfaces are beveled at the top of body 100 around holes 104 and 105 to receive the base of pivot pins 106 and 107. Extending from the base of body 100 below hole 105 is an integral rounded shaft 110 having a flat notch 112 on the end remote from body 100. A separate flat cam piece 114 is attached to shaft 110 by a disk shaped portion 115 having a bore 116 therethrough with a flat edge circumferential portion 118 of bore 116 corresponding to flat notch 112. Cam piece 114 fits snugly onto rounded shaft 110 for operation as a single piece with main body 100 and shaft 110. The horizontal pivot piece 72 has similar elements including a main body 101, pivot pins 108 and 109, shaft 111 and cam piece 117, as shown in FIG. 8.

Figure 10:
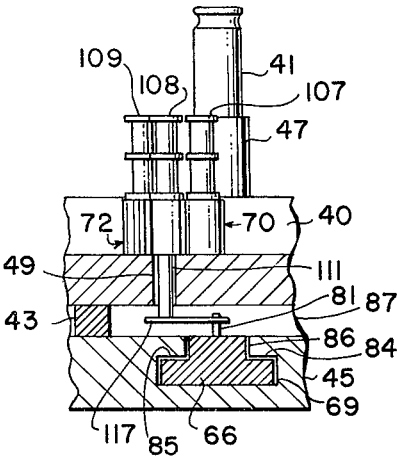
FIG. 10. is a partial sectional view of the voting machine shown in FIG. 3 taken along lines 10—10.

As shown in FIGS. 10 and 11, a T-shaped groove 69 is molded into bottom plate 41 to accommodate slide bar 66 as it moves transversely to key slide 50 in response to slide pin 64. Groove 69 includes shoulders 84 and 85 projecting toward each other near the top of groove 69 and leaving a vertical opening 86 extending the length of the groove. Slide bar 66 slides in groove 69 with shoulders 67*a* and 67*b* riding along the lower surface of shoulders 84 and 85 of groove 69. Opening 86 guides center stem 68 of slide bar 66 as bar 66 reciprocates in groove 69.

Bottom plate 45 is connected below elongate member 40 by rods 43 positioned at spaced intervals flush with the lower face of member 40 and the upper face of plate 41, leaving a space 87 between member 40 and plate 41. Connecting pins 80 and 81 of slide bar 66 extend into space 87 to contact cam pieces 114 and 117 corresponding to pivot pieces 70 and 72. As shown in FIG. 10, shaft 111 of pivot piece 72 extends through hole 49 in the bottom of elongate member 40. Cam piece 117 extends from the bottom of shaft 111 transverse to the shaft in the plane of opening 87 to contact connector pin 81 of slide bar 66. FIG. 11 shows a similar arrangement for shaft 110 of pivot piece 70.

Figure 8:
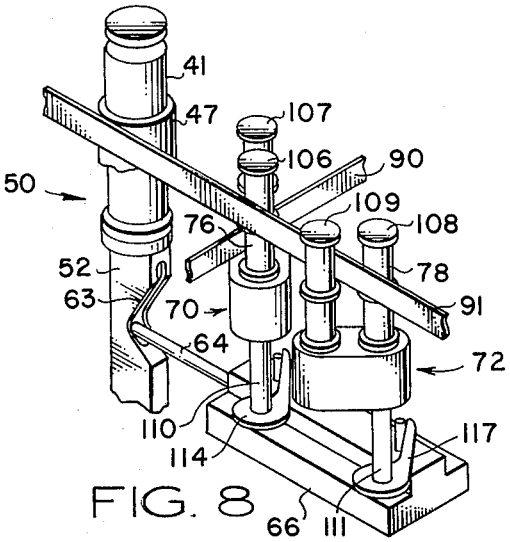
FIG. 8 is a partial perspective view showing the relationship between the voting key, slide device, pivot pieces and band interlock of the present invention with the voting key in the unvoted position.
Figure 9:
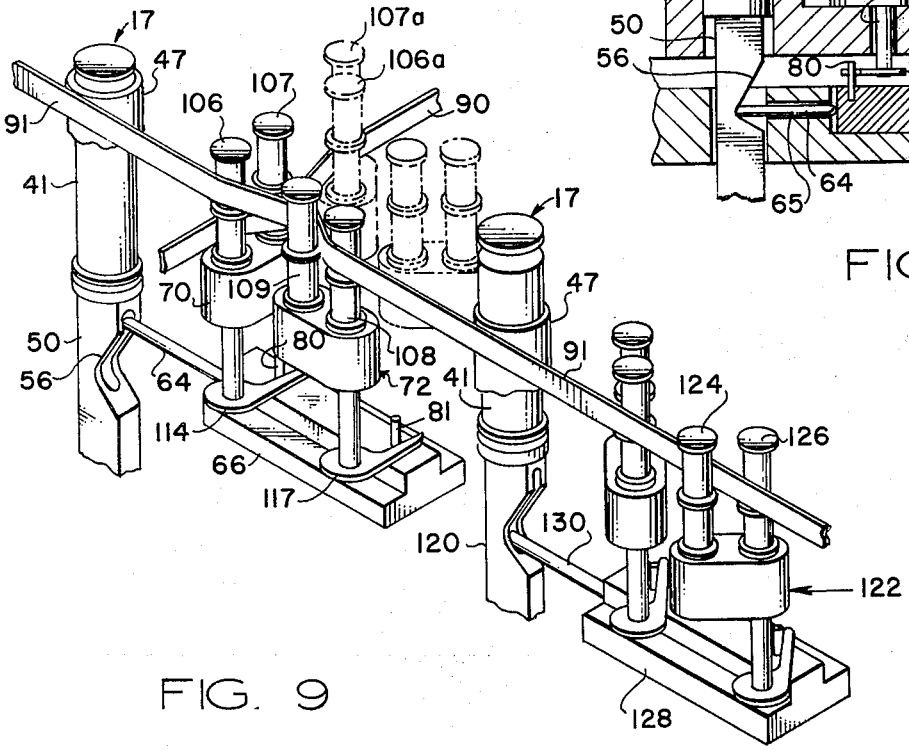
FIG. 9 is a perspective view similar to that of FIG. 7 with the voting key in the voted position and with a second voting key in the unvoted position.

The operation of key slide 50 and the column and row interlocking mechanisms are shown in FIGS. 8 and 9. In FIG. 8, key slide 50 is shown in the raised unvoted position in tube 47 with slide pin 64 resting at the bottom of groove 63. For simplicity, rods 88 which would be resting at the bottom of grooves 62 are not shown. Slide pin 64 and slide bar 66 are disposed in abutting relationship in grooves 65 and 69 respectively projecting normal to key slide 50. Pivot pieces 70 and 72 are mounted on lower level 42 of elongate member 40 adjacent key slide 50. The pivot pieces 70 and 72 are rotatably supported by rounded shafts 110 and 111 extending downward through holes 48 and 49 in lower level 42. Cam pieces 114 and 115 on shafts 110 and 111 are positioned in contact with upward extending connecting pins 80 and 81 respectively. A column interlocking band 90 is threaded between pivot pins 106 and 107 of column interlocking pivot piece 70 in contact with lower surfaces 76 and projects to suitable fastening pieces (not shown). A row interlocking band 91 is threaded between pivot pins 108 and 109 of row interlocking pivot piece 72. Band 91 is disposed above band 90 in contact with upper surfaces 78 of pins 108 and 109 and projects transversely to band 90 above upper level 44 and adjacent to press fit tubes 47 to suitable fastening pieces (not shown). Bands 90 and 91 are normally in contact with other row and column pivot pieces corresponding to other key slides. Sufficient slack is provided in bands 90 and 91 to allow at least one pivot piece to rotate.

Referring now to FIG. 9, as key slide 50 is depressed, slide pin 64 follows vertically along groove 63 of cam-shaped ramp 56 and is thus moved transversely away from key slide 50. Pin 64 slides against bar 66 moving the bar transversely away from key slide 50 within groove 69. Connecting pin 80 contacts the cam piece 114 of column locking pivot piece 70, causing the cam piece to rotate about shaft 110. Similarly, connecting pin 81 contacts and pivots row locking pivot piece 72 about its shaft 111. In the voted position, key slide 50 has been depressed in tube 47 with slide pin 64 resting at the top of groove 63. Pin 64 and slide bar 66 have moved to an extreme position away from key slide 50 and pivot pieces 70 and 72 have rotated clockwise to a fully pivoted position.

As pivot piece 70 turns, pivot pin 107 rotates about pivot pin 106 and pushes band 90 out of line between pin 107 and an adjacent pivot pin 106a. This twisting action causes some of the slack in band 90 to be taken up, increasing the tension in the band. Likewise, row interlocking band 91 is pushed out of line between pivot pins 106 and 108 by rotation of pivot pin 109 of horizontal locking pivot piece 72 removing some of the slack from band 91. If additional slack is left in interlocking bands 90 and 91, other key slides may be depressed to make additional selections within a candidate group. When sufficient key slides have been depressed to take up the slack and pull either of bands 90 and 91 taut, then the other interconnected key slides are prevented from being depressed by the blocking action of bands 90 and 91 which prevent the rotation of other interconnected pivot pieces.

in FIG. 9, key slide 50 is shown in the voted position and a second key slide 120 in the unvoted position adjacent key slide 50 in the same row. Key slide 120 has a ramp groove 132 and is provided with a row locking pivot piece 122 having pivot pins 124 and 126, a slide bar 128 and a slide pin 130 in an arrangement identical to that of key slide 50. Row interlocking band 91 is threaded between pivot pins 124 and 126 and is in tension because of the rotated position of pivot piece 72. Since band 91 is taut, pin 124 is blocked from rotation about pin 126, preventing pivot piece 122 from rotating. Slide bar 128 and slide pin 130 are thus blocked from movement away from key slide 120. The end of slide pin 130 is lodged in ramp groove 132 of key slide 120 preventing depression of the slide so that another vote may not be made. By the same means other interlocked column and row key slides may be blocked to limit the number of selections from any candidate group.

From the foregoing it may be understood that interlocking bands of varying lengths may be used to interconnect groups of selector keys. Certain keys within the group may be neutralized by removing the pivot pins so that the interlocking bands will not be affected by downward depression of the respective key slide. It is also possible to extend column and row interlocking bands into adjacent columns and rows by using removeable spools as shown in FIG. 2. Clamps 94 are provided for securing one end or both ends of the interlocking bands at any point in the columns or rows. Spool and ratchet combinations 96 are shown only at the base of column 31 and may be also provided at the base of the other columns as needed to tension additional bands.

Figure 12:
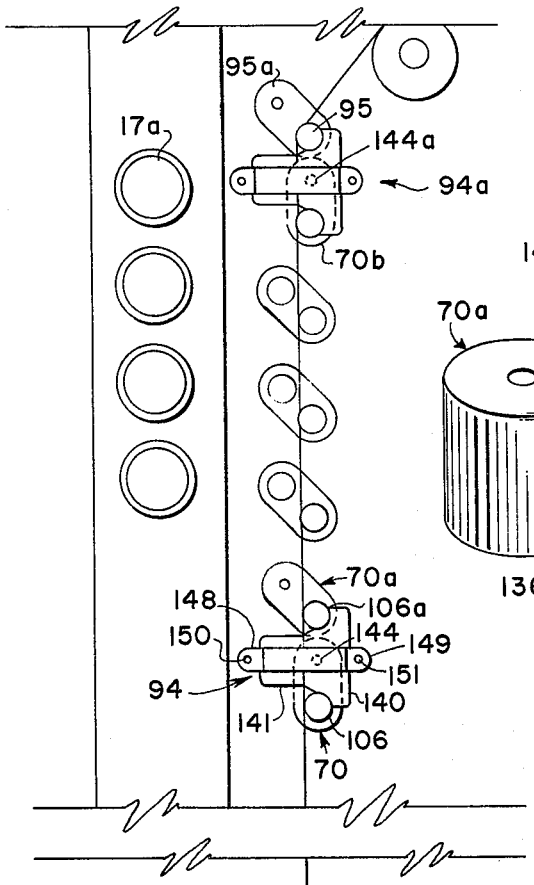
FIG. 12 is a perspective view of the clamp device for holding the interlocking bands of the present invention.
Figure 12:
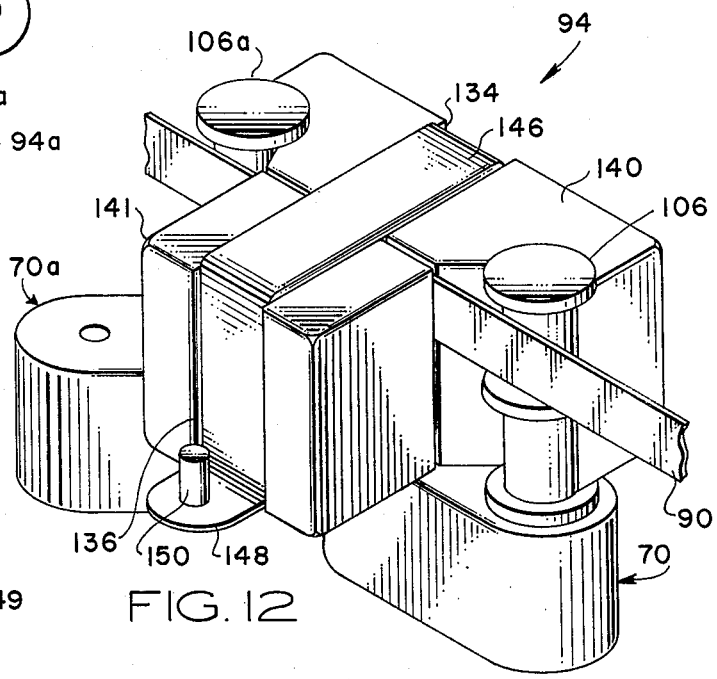
Figure 14:
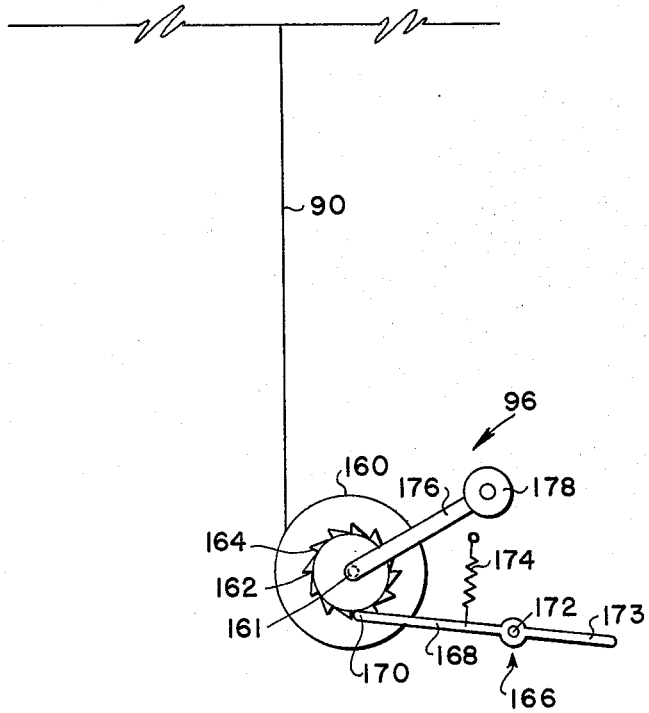
FIG. 14 is a partial plan view of the spool and ratchet combination together with the interlocking band mechanism and the clamps of the present invention.
Figure 13:
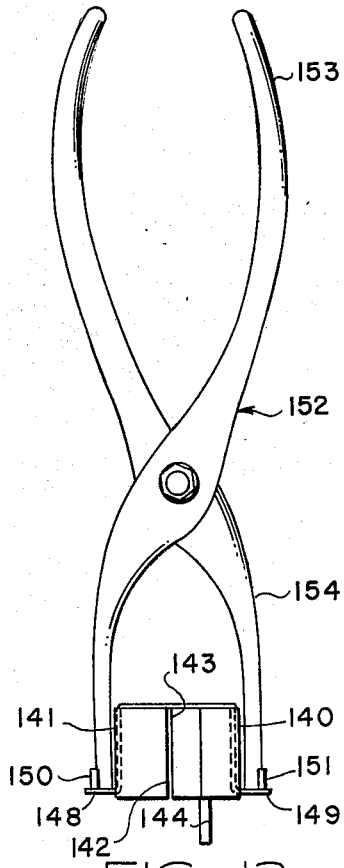
FIG. 13 is a side view of the clamp of FIG. 12 showing operation of the clamp by a tool.

One preferred embodiment of clamp 94 is shown in FIGS. 12, 13 and 14. Clamp 94 comprises a brake piece 140 and a brake shoe 141 positioned adjacent each other with opposing parallel faces 142 and 143. Vertical interlocking band 90 extends between faces 142 and 143. As shown in FIG. 12, brake piece 140 is shaped in the form of a truncated wedge to fit between pivot pins 106 and 106a of adjacent pivot pieces. Pivot pin 107 has been removed and a brake pin 144 projects downward from brake piece 140 for insertion in hole 104 in the top of pivot piece 70. Thus, brake piece 140 is wedged between pins 106 and 106a to hold brake piece 140 firmly in place.

Brake shoe 141 is connected to brake piece 140 by a U-shaped spring clip 146 which is clamped into grooves 134 and 136 on the upper and outer surfaces of brake piece 140 and brake shoe 141 to compress faces 142 and 143 tightly against interlocking band 90. The ends of spring clip 146 form flanges 148 and 149 which extend outward from brake piece 140 and brake shoe 141 respectively. Stop pins 150 and 151 project upward from the flanges. As shown in FIG. 13, clamp 94 is attached to interlocking metal band 90 by utilizing a special tool 152, such as reverse pliers, which reverses a squeezing motion on handles 153 to cause arms 154 to separate. Outward pressure is thereby applied to stops 150 and 151 which releases the compression of spring clip 146 against brake piece 140 and brake shoe 141. Clamp 94 is then positioned with brake pin 144 in hole 105 of pivot piece 70 with interlocking band 90 positioned between parallel faces 142 and 143. When compression on handles 153 of tool 152 is released, spring clip 146 causes clamp 94 to firmly grip band 90.

It can be seen that clamp 94 may be positioned on any pivot piece adjacent a disabled key in the rows and columns of the voting machine. The rotating pivot pin of a pivot piece is removed, disabling the key and leaving a hole for the clamp to be inserted. As shown in FIG. 14, several clamps may be placed along a given column to isolate separate candidate groups. A spool and ratchet mechanism 96 is positioned at the bottom of the column and is utilized to provide the proper tension on the interlocking band as the clamps are applied.

The spool and ratchet mechanism 96 includes a round spool 160 anchored to the framework 39 of the voting machine by a shaft 161 through the center of spool 160. A ratchet wheel 162 is mounted concentrically above spool 160 and has angled teeth 164 around its periphery. A pawl member 166 is connected to the framework 39 of the voting machine adjacent spool 160. Pawl member 166 includes a pawl arm 168 extending to ratchet wheel 162. Arm 168 ends in a point 170 which fits between angled teeth 164 of ratchet wheel 162 to prevent counter clockwise movement of the wheel. Pawl member 166 is rotatably mounted about a pivot point 172 and includes a handle 173 for releasing ratchet wheel 162. A coil spring 174 is connected between pawl arm 168 and framework 39 to bias arm 168 against teeth 164. A removeable handle arm 176 is connected to shaft 161 at the center of spool 160 and extends outward, ending in a handle 178 for turning spool 160.

In setting up the selection groups in a given column, a first clamp 94a is positioned on the top pivot piece 70*b* of the column with one end of column interlock band 90 attached thereto. The top pivot pin of pivot piece 70*b* has been removed, disabling the piece. The brake pin 144*a* of clamp 94*a* has been inserted into the empty hole left by the removed pivot pin. The clamp 94*a* is wedged between the lower pin of pivot piece 70*b* and post 95 mounted on a stationary piece 95*a* at the top of the column. Although the top voting button 17*a* has been disabled, there is no extra loss of voting space on the ballot since the top row is normally used for headings, as shown in FIG. 1.

The lower end of interlocking band 90 is connected to spool 160 of spool and ratchet mechanism 96. Band 90 is then slackened and a number of key slides are depressed depending upon the number of selections to be allowed within the top voting group. Spool and ratchet mechanism 96 is then rotated to place band 90 under tension sufficient to prevent other selection keys from being depressed. Spool 160 is held in the tensioning position by pawl arm 168 which maintains contact against the teeth 164 of ratchet wheel 162. The clamp 94 is placed below the lowermost candidate of the first selection group. The depressed key slides are then raised to a non-voted position and the selector group is ready for voting. After the required number of candidates have been voted in the group, the slack in interlocking band 90 between clamps 94a and 94 will have been totally taken up and further voting will be prevented.

Additional clamps may be added further down the column to segregate other candidate groups, Again, the spool and ratchet mechanism 96 is used to preset the band portions for each candidate group. A similar procedure may also be used to set up candidate groups in the rows of the voting machine. As shown in FIG. 2, clamp 98 is attached to the right hand end of interlocking band 91, and anchor 97 holds the lefthand side of the band. Band 91 is pulled to provide the appropriate tension by a pair of pliers or some other suitable tool and then attached to anchor 97. It is understood that spool and ratchet mechanisms may also be used for tensioning the row interlocking bands.

It will be understood from the foregoing description that the present invention presents several advantages over the prior art. The band interlocking system allows the interconnecting of candidate groups in columns or rows in a variety of combinations. More than one column or row may be included on the same interlocking band by using idler spools. Any given selection key may be interconnected in columns or rows or both. In addition, a selector key adjacent an interlocking band may be disengaged from the interlock system by removing the pivot pins adjacent the key. Moreover, the number of candidates to be selected from a given group may be varied by simply changing the tension on the band by the spool and ratchet mechanism. Voting may be in any order within the group and may be changed by the voter by simply raising one selection key and pressing another before vote bar 22 is pressed.

Figure 15:
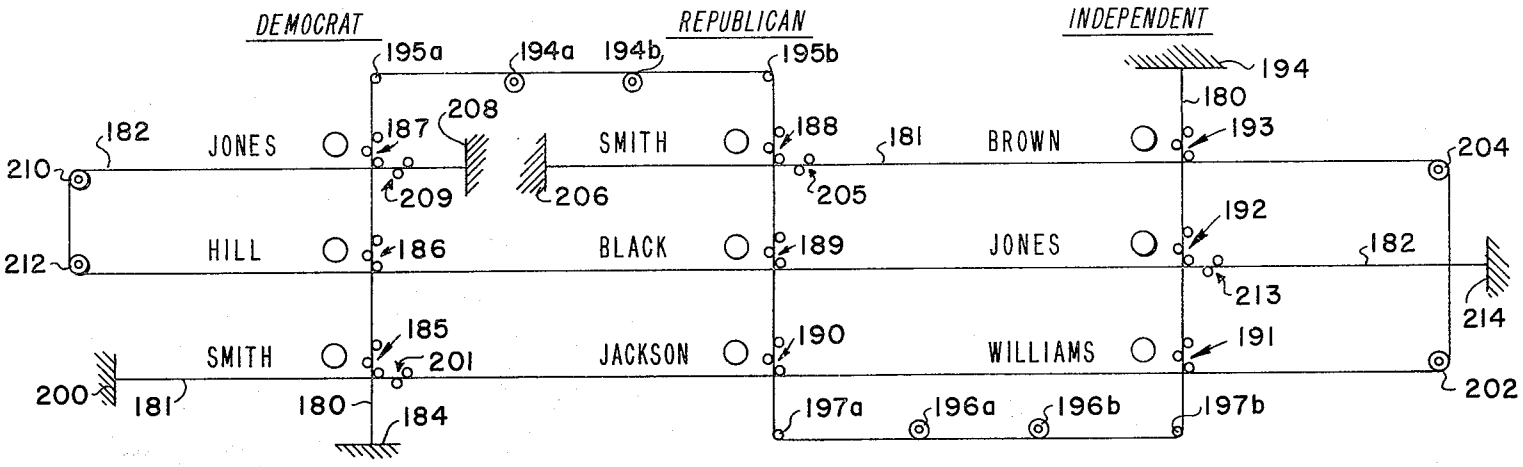
FIG. 15 is a diagrammatic view showing an interlocking pattern for the voting machine of the present invention.

The foregoing features provide the present voting machine with great flexibility, and the ability to handle unusual voting combinations and requirements. Referring now to FIG. 15, a voting pattern is shown for the machine of the present invention which will accommodate one unusual type of voting combination. In this situation, several candidates are presented from a number of parties with several votes being permitted for the candidates in any combination. The situation is further complicated by the fact that the same individual may have his name presented under more than one party but may only be voted for once when the three selections are made. In FIG. 15, nine candidates are shown, three under each of adjacent Democratic, Republican and Independent party columns, and a total of three votes is allowed. It will be noted that Jones is listed under both the Democratic and Independent party and Smith is listed as both a Democrat and a Republican.

A multiple column interlocking band 180 and two multiple row interlocking bands 181 and 182 are needed to provide the necessary interconnections between candidates. The voting machine is presented in diagrammatic form with the ballot showing only the voting button, the pivot pins, the interlocking bands and interconnecting spools. It is understood that this presentation is simply for purposes of simplicity and clarity, and the other previously described mechanisms would also normally be included.

Referring first to vertical interlocking band 180, an anchor 184, such as spool and ratchet mechanism 96, is provided at one end of the band. Band 180 is threaded up the first column between the vertical interlocking pins 185–187 for each name in the Democratic column and is then looped over spools 194a and 194b and posts 195a and 195b to return between the Republican column interlocking pins 188–190. Band 180 then passes over spools **196*a* and 196*b* and posts 197*a* and 197*b*. Finally, band 180 is threaded between the column interlocking pins 191–193 of the Independent party column and connected by a suitable anchor 194. Thus, band 180** interconnects all candidates and is preset with sufficient slack for only three choices.

A first row interlocking band 181 interconnects Smith in the Democratic column with Smith in the Republican column to assure that only one vote is cast for that candidate. An appropriate anchor 200 is connected to one end of interlocking band 181 adjacent the Democratic Smith candidate. Band 181 is threaded between row interlocking pins 201 adjacent the Democratic Smith candidate and extends along the bottom row to a spool 202 at the far right side. Band 181 then runs upward to a second spool 204 at the right side of the first row. Band 181 extends along the top row and is threaded between the row interlocking pins 205 for Smith under the Republican column and then connected to an anchor 206. It is noted that the row interlocking pins for the other candidates along the line of travel, that is for Jackson, Williams and Brown, have been removed so that a vote for one of those candidates will not affect the tension on interlocking band 181.

A second interlocking band 182 connects Jones as a Democratic candidate with Jones as an Independent candidate to prevent more than one vote for Jones. An anchor 208 is connected to one end of band 182 which is threaded through row interlocking pivot pins 209 adjacent the Jones key in the Democratic column. Band 182 extends along the first row to a spool 210 at the left hand side of the row. Band 182 then extends downward to the second row around a second spool 212 along the second row through the row interlocking pins 213 adjacent the Jones key in the Independent column. Finally, band 182 is connected to an anchor 214 on the other side of pins 213. Bands 181 and 182 are both tensioned to allow only one selection so that neither Jones nor Smith may be voted for twice.

It is thus seen that the voting machine pattern illustrated in FIG. 15 will allow votes for any three of the candidates but will not allow the same candidate to be voted for more than once, regardless of how many times his name appears. Of course, it is understood that a similar arrangement may be used for a different number of candidates or a situation where other names may be presented more than once.

Figure 16:
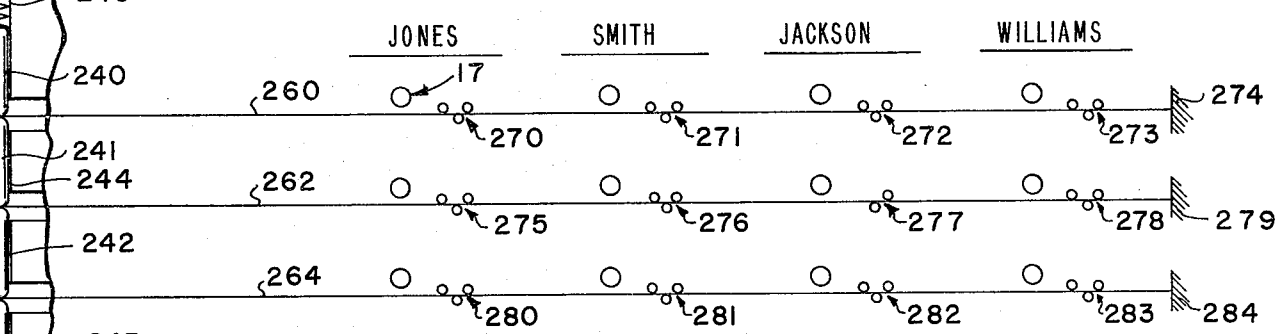
FIG. 16 is a diagrammatic view showing another interlocking pattern for the voting machine of the present invention using a special patch plate.
Figure 17:
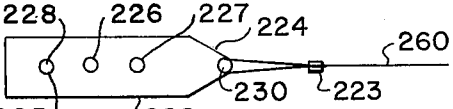
FIG. 17 is a plan view of the slide bar for the patch plate of FIG. 16.
Figure 18:
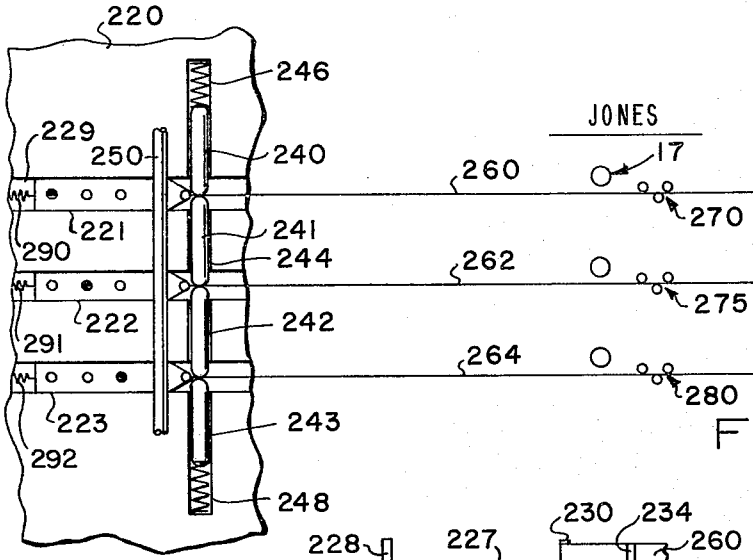
FIG. 18 is an elevational view of the slide bar of FIG. 17.

FIGS. 16, 17 and 18 present a second voting machine pattern illustrating how the present invention can easily accommodate difficult voting requirements. In this situation, three votes may be cast for any of a group of candidates in the following combinations: 1 vote for each of three candidates, 1 ½votes for each of two candidates, or 3 votes for one candidate. A patch plate 200 is attached by suitable means (not shown) to the right hand side of framework 39 in place of anchor pieces 97. Patch plate 200 includes a plurality of rectangular slide bars 221, 222 and 223, similar to slide bars 66, except that one end of each bar forms a point 223. The slide bars are positioned to the left of each row of voting buttons and disposed for sliding in grooves 229 in patch plate 220 along the axis of the button rows.

Tension coils 290, 291 and 292 are fastened between patch plate 220 and the rear of slide bars 221, 222 and 223 respectively, to bias the slide bars backward and maintain tension on the interlock bands. Slide bar 221 is shown in FIGS. 17 and 18 with the understanding the slide bars 222 and 223 are similar or identical. The top of slide bar 221 is provided with three longitudinally spaced holes 225, 226 and 227 and a removeable index pin 228 which may be positioned in any of the three holes. A connecting pin 230 projects upward from slide bar 221 at front point 224. The end of an interlocking row band 260 is looped around pin 230 and fastened to itself by an appropriate clamp 234. Interlock pins 240, 241, 242 and 243 extend transversely between each of slide bars 222, riding in a common transverse groove 244 in patch plate 220. A spring receptacle 246 is provided adjacent the upper end of interlock pin 240 and a second spring receptacle 248 abuts lower interlock pin 243. A stop rod 250 extends transversely across the tops of slide bars 221, 222 and 223 to establish contact with index pins 228 when the slide bars have moved forward in troughs 224 a predetermined distance.

In operation, patch plate 220 is positioned adjacent to the first three rows of voting buttons 17 for the four candidates shown in FIG. 16. Index pin 228 on slide bar 221 is placed in the rearward hole 225. A first row interconnecting band 260 is connected to the front post 230 of slide bar 221 and is threaded between the row interlock pivot pins 270–273 in the first row. The three voting buttons in the first row are depressed to a voted position, and band 260 is drawn taut with index pin 228 resting against stop rod 250. Band 260 is connected to an appropriate anchor 274 on the right side of the first row. The three depressed voting buttons are then raised to the unvoted position allowing slide 221 to be pulled to the left so that point 224 is just to the left of interlock pins 240 and 241. Hole 225 is set at a precise distance with respect to interlock pins 240 and 241 and stop rod 250 so that band 260 will be taut with slide bar 221 in this position. With pin 228 in hole 225, slide bar 221 may move forward a calibrated distance to allow three choices to be made before pin 228 abuts stop rod 250. Thus, three selections are permitted in the first row with each choice being worth only one vote.

In the second row, each choice is given a weight of 1½ votes. A second interlock band 262 is threaded between interlock pivot pins 275–278 in the second row and fastened to front pin 230 of slide bar 222. Index pin 228 is placed in hole 226 and two voting buttons in the second row are depressed to the voted position. Band 262 is then drawn taut with index pin 228 resting against stop rod 250. The two depressed voting buttons are then raised to the unvoted position and slide 222 is pulled to the left so that point 224 is positioned just to the left of interlock bars 241 and 242. Hole 226 is likewise calibrated with respect to point 224 and stop rod 250 so that band 262 is taut with slide bar 222 in this position. With index pin 228 in hole 226, slide bar 222 may move to the right to allow for two choices in the second row before being blocked by stop rod 250.

Finally, in the third row, a third interlock band 264 is threaded through interlock pivot pins 280–283 and connected to front pin 230 of slide bar 223. One voting button is depressed to the voted position and band 264 is drawn taut with index pin 228 in hole 227. The voted button is then raised and slide bar 223 is moved just to the left of interlock pins 242 and 243. In this position, slide bar 223 may move to the right to allow one vote in the third row before index pin 228 rests against stop rod 250. Thus, one choice is allowed in the third row with a weight of three votes for the selected candidate.

It is noted that after the first vote in any row, the corresponding slide pin is pulled forward sufficiently to wedge the point 224 between two of the interlocking pins 240-243. This action causes the other pins to move transversely to the corresponding slide bars and effectively block any movement of the slide bars other than the one already voted. Thus, if a choice is made in the first row, one may not thereafter place a vote in the second or third row. The same arrangement holds true with respect to a vote in the other two rows.

It will be seen from the foregoing discussion that the interlocking machine of the present invention may be easily modified with a patch plate to provide additional versatility to the system of the present invention. Other similar modifications are readily apparent and are considered to be within the scope of the present invention.

Although preferred embodiments of the invention have been described in detail, it is to be understood that various changes, substitutions and alterations can be made therein without departing from the spirit and scope of the invention as defined by the appended claims.

What is claimed is:

1. In a voting machine having a plurality of aligned voting keys, each of said keys being moveable between an unvoted position and a voted position, a mechanical interlock comprising:

a plurality of cam means each associated with one of said keys, a plurality of slide means each adjacent one of said cam means for sliding in response to movement of said keys from the unvoted position to the voted position, a plurality of pivot members each associated with one of said keys rotatably mounted for rotating in response to the sliding of one of said slide means, and means for selectively interlocking certain of the pivot members associated with certain of said voting keys including common means for interconnecting each of said certain pivot members and blocking means removably attached to said each of said certain pivot members for contacting said common means to block rotation of said certain pivot members in response to a predetermined number of said certain voting keys having been moved to the voted position, whereby subsequent movement of additional of said certain voting keys to the voted position is prevented.

2. The mechanical interlock of claim 1 wherein each one of said slide means comprises a moveable pin in contact with the cam means corresponding to said one slide means and a slide bar responsive to movement of said pin to abut and rotate the pivot member corresponding to said one slide means.

3. The mechanical interlock of claim 1 wherein said common means comprises a band extending adjacent to said certain aligned voting keys in contact with said blocking means on said certain pivot means, said band being secured at both ends to provide tension against said blocking means to block rotation of said certain pivot means after said predetermined number of keys have been moved.

4. The mechanical interlock of claim 1 wherein each one of said blocking means comprises a removable pivot piece on said pivot member in alignment with the pivot pieces of each of the other voting keys, and a stationary piece on said pivot member in alignment with the stationary pieces of each of the other voting keys, said pivot piece being mounted for independent rotation about said stationary piece in response to the sliding of said slide means.

5. The mechanical interlock of claim 4 wherein said common means comprises a tensioned band extending in parallel to the alignment of said pivot pieces and parallel to the alignment of said stationary pieces in blocking contact with certain of said pivot pieces and stationary pieces to block rotation of said certain pivot pieces upon rotation of a predetermined number of said pivot pieces.

6. The mechanical interlock of claim 1 wherein each one of said cam means comprises a sloped surface on the key corresponding to said one cam means in contact with the slide means corresponding to said one cam means to shift said corresponding slide means as said corresponding key is moved from the unvoted to the voted position.

7. In a voting machine having a plurality of aligned voting keys, each key being moveable from an unvoted position to a voted position, the combination comprising:

a plurality of rotating members each associated with one of said aligned voting keys including a pivot piece removably attached to said each rotating member for pivoting about a point adjacent to said one key in response to movement of said one key between said unvoted position and said voted position; and band interlock means adjacent said voting keys interconnecting said plurality of rotating members for blocking pivoting of said pivot pieces in response to a predetermined number of said keys having been moved from the unvoted position to the voted position, to prevent other of said keys from subsequently being moved to the voted position.

8. The combination of claim 7 and further comprising cam means on each of said voting keys and a plurality of slide means each associated with one of said cam means for sliding in response to movement of one of said keys from the unvoted position to the voted position, each of said slide means being in contact with one of said rotating members to pivot said one rotating member about said point in response to the sliding of said slide means.

9. The combination of claim 7 wherein said band interlock means comprises an elongated band extending parallel to said aligned voting keys and fastened at both ends so that said band has a predetermined amount of slack, said band extending adjacent each of said pivot pieces so that said slack is reduced in response to pivot pieces rotating against said band.

10. A selection machine comprising:

an elongate selection column;

a plurality of selector keys each having cam means associated therewith and moveable relative to said column from a first neutral position to a second registered position;

a plurality of shifting means each being in contact with one of said cam means for blocking movement of one of said selector keys after a predetermined number of said keys have been moved to said second registered position;

a plurality of pivot members each being rotatably mounted in abutting contact with one of said shifting means for blocking movement of said one shifting means after said predetermined number of said keys have been moved to said second registered position; and band interlock means in contact with said pivot members to prevent rotation of said pivot members after said predetermined number of said keys have been moved to said second registered position thereby blocking movement of other of said keys to said second registered position.

11. A voting machine comprising:

a frame member;

a plurality of aligned voting keys slidably mounted on said frame to slide from a first unvoted position to a second voted position, each key having at least one cam surface thereon;

a plurality of slide bars each associated with one of said cam surfaces for shifting normal to the sliding movement of one of said keys in response to said movement;

a plurality of pivot pieces each rotatably mounted adjacent one of said keys and responsive to one of said slide bars, said pivot pieces each including a first pivot pin removably attached to said each pivot piece and rotatable about a second pivot pin; and an interlocking band extending parallel with said voting keys between each of said first and second pivot pins, said band being secured at both ends and having a predetermined amount of slack which is reduced in response to the rotation of each of said pivot pieces, whereby said band is placed in blocking tension to prevent rotation of each of said first pins about each of said second pins after a predetermined number of keys have been moved to the second voted position.

12. The voting machine of claim 11 and further comprising a plurality of slide pins each being between one of said cam surfaces and one of said slide bars for shifting said one slide bar in response to movement of said one cam surface.

13. A selection machine comprising:

a. a plurality of columnar frame members;

b. a plurality of selection keys aligned in columns and rows on said frame members each being laterally moveable from a first position to a second position to indicate a selection;

c. column interlock means for limiting the number of selected keys in a column, including 1. a plurality of slide means each in contact with one of said keys for shifting transverse to the lateral movement of said key in response to a selection, 2. a plurality of first pivot members each responsive to one of said slide means for rotating in response to a selection, certain of said first pivot members each having a first pivot piece removably mounted thereon, and 3. first band interlock means in contact with the first pivot pieces on said certain of said first pivot members to block rotation of each of said certain first pivot members which has not been rotated after a first predetermined number of selections have been made, and d. row interlock means for limiting the number of selected keys in a row, including 1. a plurality of second pivot members each responsive to one of said slide means for rotating in response to a selection, certain of said second pivot members each having a second pivot base removably mounted thereon, and 2. second band interlock means in contact with the second pivot pieces of said certain of said second pivot members to block rotation of each of said certain second pivot members which has not been rotated after a second predetermined number of selections have been made.

14. The selection machine of claim 13 wherein said first interlock means comprises a first band extending adjacent said certain first pivot members in contact with said removable first pivot pieces, said first band being tensioned to allow rotation of only said first predetermined number of said certain first pivot members.

15. The selection machine of claim 13 wherein said second interlock means comprises a second band extending adjacent said certain second pivot members in contact with said removable second pivot pieces, said second band being tensioned to allow rotation of only said second predetermined number of said certain second pivot members.

16. In a voting machine having a plurality of aligned voting keys, each of said keys being moveable between an unvoted position and a voted position, a mechanical interlock comprising:

a plurality of cam means each associated with one of said keys, a plurality of slide means each adjacent one of said cam means for sliding in response to movement of said keys from the unvoted position to the voted position, a plurality of pivot means each associated with one of said keys for rotating in response to the sliding of one of said slide means, and means for selectively interlocking certain of the pivot means associated with certain of said voting keys to block rotation of said certain pivot means in response to a predetermined number of certain voting keys having been moved to the voted position, whereby movement of additional of said certain voting keys to the voted position is prevented, wherein each one of said certain pivot means comprises a pivot piece rotatably mounted adjacent the voting key corresponding to said one pivot means for rotating in response to the sliding of the slide means corresponding to said corresponding key, and a removable pin for selectively attaching to said pivot to contact said interlocking means, whereby said interlocking means blocks rotation of said certain pivot means by contacting the removeable pins corresponding to said certain pivot means.

17. In a voting machine having a plurality of aligned voting keys, each of said keys being moveable between an unvoted position and a voted position, a mechanical interlock comprising:

a plurality of cam means each associated with one of said keys, a plurality of slide means each adjacent one of said cam means for sliding in response to movement of said keys from the unvoted position to the voted position, a plurality of pivot means each associated with one of said keys for rotating in response to the sliding of one of said slide means, and means for selectively interlocking certain of the pivot means associated with certain of said voting keys to block rotation of said certain pivot means in response to a predetermined number of said certain voting keys having been moved to the voted position, whereby movement of additional of said certain voting keys to the voted position is prevented, wherein each one of said pivot means comprises at least two posts adjacent the voting key corresponding to said one pivot means, the first post being mounted to rotate about the second post, and wherein said interlocking means comprises a band threaded between each of said two posts along a line parallel to said aligned keys, said band being fastened at both ends to establish a predetermined amount of slack in said band, whereby partial rotation of each of said first posts around the corresponding second post will bend a portion of said band out of said line and decrease the slack in said band.

18. A selection machine comprising:

a. a plurality of columnar frame members;

b. a plurality of selection keys aligned in columns and rows on said frame members each being laterally moveable from a first position to a second position to indicate a selection;

c. column interlock means for limiting the number of selected keys in a column, including 1. a plurality of slide means each in contact with one of said keys for shifting transverse to said key in response to a selection,
2. a plurality of first pivot means each responsive to one of said slide means for rotating in response to a selection, and
3. first band interlock means in contact with certain of said first pivot means to block rotation of each of said certain first pivot means which has not been rotated after a first predetermined number of selections have been made, and d. row interlock means for limiting the number of selected keys in a row, including 1. a plurality of second pivot means each responsive to one of said slide means for rotating in response to a selection, and
2. second band interlock means in contact with certain of said second pivot means to block rotation of each of said certain second pivot means which has not been rotated after a second predetermined number of selections have been made, wherein each of said first and second pivot means comprises a pair of removeable pivot pins rotatable with respect to each other in response to movement of one of said selection keys.

19. The selection machine of claim 18 wherein each of said first and second band interlock means comprises a band having a predetermined amount of slack threaded between said pairs of pivot pins, and wherein said pairs of pivot pins rotate in response to movement of said selection keys to take up said predetermined amount of slack, whereby said band is drawn taut and blocks rotation of each of said pivot pins which has not been rotated after a number of selections have been made.

* * * * *